US006293181B1

(12) United States Patent
Hajek, Jr. et al.

(10) Patent No.: US 6,293,181 B1
(45) Date of Patent: Sep. 25, 2001

(54) CONTROL SYSTEM PROVIDING A FLOAT CONDITION FOR A HYDRAULIC CYLINDER

(75) Inventors: Thomas J. Hajek, Jr., Lockport; Srikrishnan T. Tolappa, Aurora; Daniel T. Mather, Lockport, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/400,670

(22) Filed: Sep. 21, 1999

Related U.S. Application Data

(63) Continuation-in-part of application No. 09/061,431, filed on Apr. 16, 1998, now abandoned.

(51) Int. Cl.[7] ..... F15B 13/10

(52) U.S. Cl. ..... 91/464; 91/445; 91/446; 91/441; 60/478

(58) Field of Search ..... 60/478; 91/441, 91/444, 445, 446, 447, 464

(56) References Cited

U.S. PATENT DOCUMENTS

| | | | |
|---|---|---|---|
| 3,039,823 | 6/1962 | Eaton | 60/478 |
| 3,908,515 | 9/1975 | Johnson | 91/420 |
| 4,535,809 | 8/1985 | Andersson | 137/596.14 |
| 4,945,723 | 8/1990 | Izumi et al. | 60/426 |
| 5,207,059 | 5/1993 | Schexnayder | 60/465 |

*Primary Examiner*—F. Daniel Lopez
(74) *Attorney, Agent, or Firm*—J. W. Burrows

(57) ABSTRACT

A control system is provided with a float condition to permit a double acting hydraulic cylinder to freely extend or retract in response to external forces acting on the hydraulic cylinder. The system includes a pair of pilot operated poppet valves disposed between the opposite sides of the hydraulic cylinder and a directional control valve. The pilot condition is obtained by opening a pair of pilot operated control valves to vent the control chambers of the poppet valves to a tank through a pair of float check valves. The float check valves are operative to prevent higher pressure fluid from being transmitted from the tank to the control chambers of the poppet valves when a negative pressure occurs in the side of the hydraulic cylinder that is connected to the control chamber.

9 Claims, 3 Drawing Sheets

CONTROL SYSTEM PROVIDING A FLOAT CONDITION FOR A HYDRAULIC CYLINDER

This application is a continuation-in-part of application Ser. No. 09/061,431, filed on Apr. 16, 1998 now abandoned.

TECHNICAL FIELD

This invention relates generally to a hydraulic control system for a double acting hydraulic cylinder and, more particularly, to a control system providing a float condition interconnecting the opposite sides with each other and to a tank.

BACKGROUND ART

Many earthmoving and utility type industrial machines have one or more hydraulic lift cylinders for controlling the elevational position of an implement such as a bucket or blade. It is advantageous in some cleanup operations to allow the implement to float along the surface so that the implement follows the contour of the surface without operator intervention. This is typically accomplished by providing the directional control valve with a float position at which the opposite sides of the hydraulic cylinder and the tank are all interconnected to permit the hydraulic cylinder to extend and retract as the implement follows the surface contour. Since the float position is generally detented, it becomes common practice to use the float position for lowering the implement from its raised position during normal operations.

The current trend in earthmoving machines is to install zero leak poppet valves between the directional control valve and the lift and retract sides of the lift cylinder to essentially prevent extension and retraction of the cylinder without an operator command to do so. Poppet valves have also been used in place of control valves to control the flow of fluid to and from the cylinder. A common type of poppet valve used in this environment has a reactive chamber in direct communication with the respective lift or retract side of the lift cylinder and a control chamber defined at the back side of the poppet and communicating with the reactive chamber through a fixed or variable orifice. The reactive surface defining the reactive chamber has a smaller effective surface than the back side of the poppet such that the poppet can be opened and closed by controlling the pressure in the control chamber. Generally, this is accomplished with an area control valve disposed between the control chamber and the tank. It is recognized that the subject invention is not limited to lift cylinders. It is recognized that the subject invention can be used on other fluid cylinders or motors without departing from the essence of the subject invention.

One of the problems encountered therewith is providing a float function in which fluid can pass from one side of the cylinder and/or the tank through the poppet valve to the other side of the cylinder. For example, a negative pressure is commonly generated in one side of the cylinder due to rapid movement of the implement, such as by lowering of the implement supported by the cylinder. It was discovered that this negative pressure communicates with the control chamber of the poppet valve and tends to draw fluid from the tank through the opened area control valve. The higher, atmospheric pressure in the tank acting on the back side of the popper valve moves the poppet valve to its closed position disrupting the float function.

Thus it would be desirable to provide a float condition for a hydraulic control system having a poppet valve disposed between at Least one side of a fluid actuator and a tank, such as, a double acting hydraulic cylinder to permit the cylinder to freely extend and retract in response to external forces without operator intervention.

The present invention is directed to overcoming one or more of the problems as set forth above.

DISCLOSURE OF THE INVENTION

In one aspect of the present invention, a control system provides a float condition for a double acting hydraulic cylinder adapted to be connected to a work implement of a machine and has a retract side and an extend side. The system comprises first and second poppet valve disposed between a tank and the extend side of the cylinder and having a control chamber and an orifice continuously communicating the control chamber with the extend side. A pilot operated control valve has an operative position to exhaust fluid from the control chamber of the poppet valve. A pilot valve has an operative position for simultaneously moving the pilot operated control valve to its operative position. A float check valve disposed downstream of the control chamber of the poppet valve to prevent flow of fluid back to the control chamber.

BEST MODE FOR CARRYING OUT THE INVENTION

Figure 1:
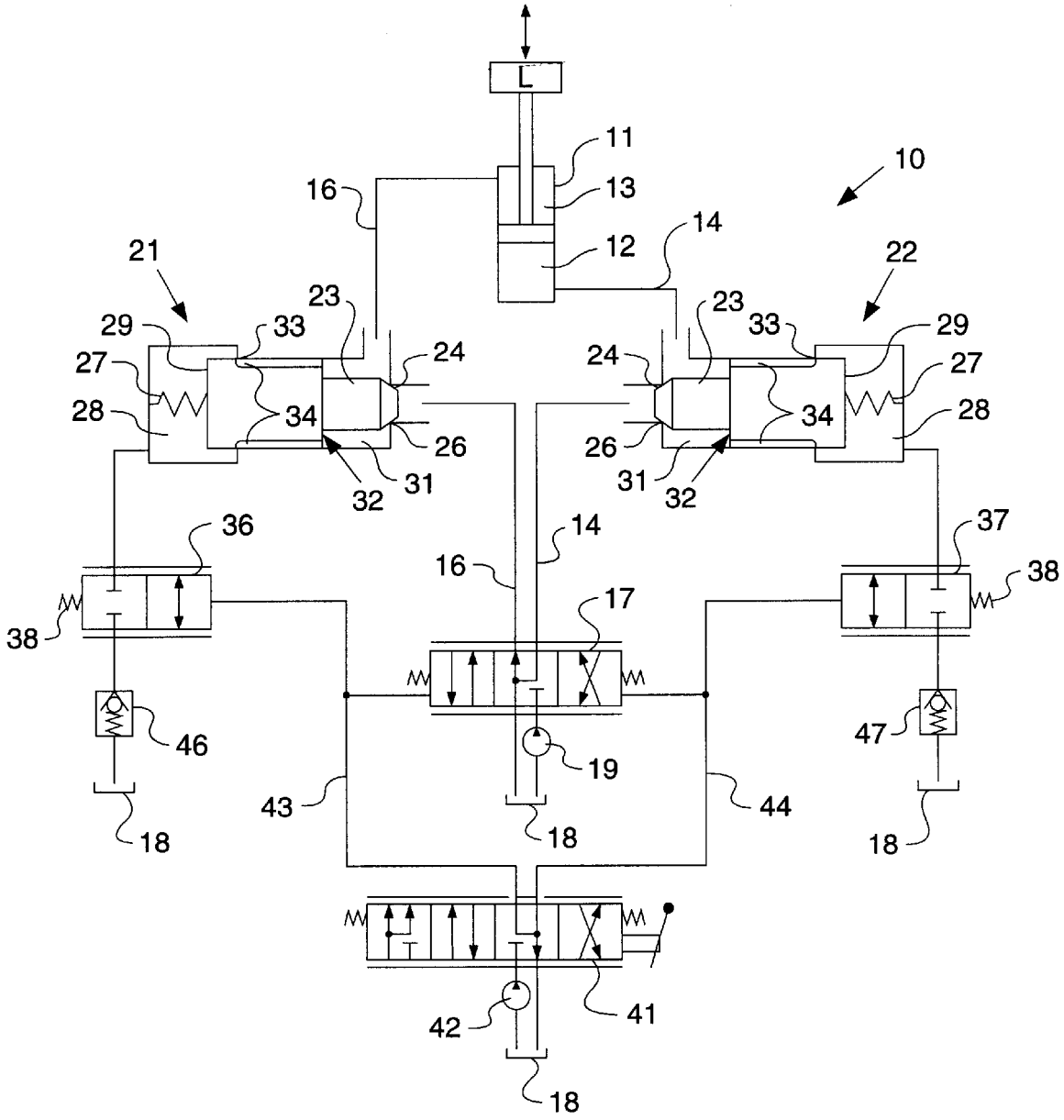
FIG. 1 is a partial diagrammatic and partial schematic representation of one embodiment of the present invention.

Referring to the drawing, and more particularly to FIG. 1, a control system 10 provides a float condition for a double acting hydraulic cylinder 11 having an extend side 12 and a retract side 13. The cylinder 11 is adapted to be connected to an implement such as a bucket or blade which imposes a load "L" tending to extend or retract the cylinder as shown by the arrow in this embodiment. A pair of conduits 14,16 connect the extend and retract sides 12,13 to a pilot operated directional control valve 17 which is shown at an operative position communicating the conduits with each other and to a fluid tank 18. The directional control valve is movable rightward to a position communicating a main supply pump 19 to the conduit 14 and the conduit 16 with the tank 18 and leftward to a position communicating the pump 19 with the conduit 16 and the conduit 14 with the tank 18. It is recognized that the directional control valve 17 could be a four position valve wherein the center position could be blocked and the fourth position would have the conduits 14,16 interconnected with the tank 18.

In the subject embodiment, the tank 18 is a tank that is vented to the atmosphere but could be subjected to some low positive pressure due to high volumes of fluid entering the tank very quickly.

A pair of flow amplifying poppet valves 21,22 are disposed for controlling fluid flow through the conduits 14,16 primarily in the direction from the hydraulic cylinder 11 to the directional control valve 17. Each of the poppet valves includes a poppet 23 having a conical valve face 24 urged into sealing contact with an annular valve seat 26 by a low force spring 27 disposed within a control chamber 28 at the back side 29 of the poppet 23. Each of the poppet valves also has a reaction chamber 31 defined by a reactive surface generally indicated by the reference numeral 32. The reactive surface has a smaller effective area than the back side 29 of the poppet. The reaction chamber 31 continuously communicates with the control chamber 28 through a variable area orifice 33 defined by a pair of metering slots 34. Even though a variable area orifice 33 is illustrated in each of the embodiments, it is recognized that the reaction chamber 31 could be in communication with the control chamber 28 through a fixed orifice without departing from the essence of the subject invention. The reaction chamber 31 of the poppet valve 21 continuously communicates with the retract side 13 of the hydraulic cylinder 11 through a portion of the conduit 16. Similarly, the reaction chamber 31 of the poppet valve 22 continuously communicates with the extend side 12 of the hydraulic cylinder 11 through a portion of the conduit 14. Thus fluid from the cylinder passing into the control chambers 28 serves as the pilot supply for controlling the position of the respective poppets 23.

A pair of area control pilot operated valves 36,37 are disposed between the control chambers 28 of the poppet valves 21,22 respectively and the tank 18. The pilot operated valves are resiliently biased to their closed position shown by a spring 38 and are movable in a direction against the bias of the springs to an open flow communicating position.

A manually actuatable pilot control valve 41 is connected to a pilot pump 42, the tank 18 and to the pilot operated valves 36,37 through a pair of pilot lines 43,44. The pilot lines 43,44 are also connected to the opposite ends of the directional control valve 17. The pilot control valve 41 at the position shown communicates the pilot lines 43,44 with the tank 18. The pilot control valve 41 is movable in a leftward direction to establish infinitely variable communication between the pump 42 and the pilot line 44 and between the pilot line 43 and the tank 18. The pilot control valve 41 is movable in a rightward direction to establish infinitely variable communication between the pump 42 and the pilot line 43 and between the pilot line 44 and the tank 18. The pilot control valve is movable to an extreme rightward float position at which the pump 42 communicates with both pilot lines 43,44.

A pair of float checks valve 46,47 are disposed between the pilot operated valves 36,37 and the tank 18 to block flow of fluid from the tank to the control chambers 28 of the poppet valves 21,22 when the pilot operated control valves 36 are in their open positions. Alternatively, the float check valves can be disposed between the pilot operated valves 36,37 and the control chambers 28 of the poppet respective valves.

Figure 2:
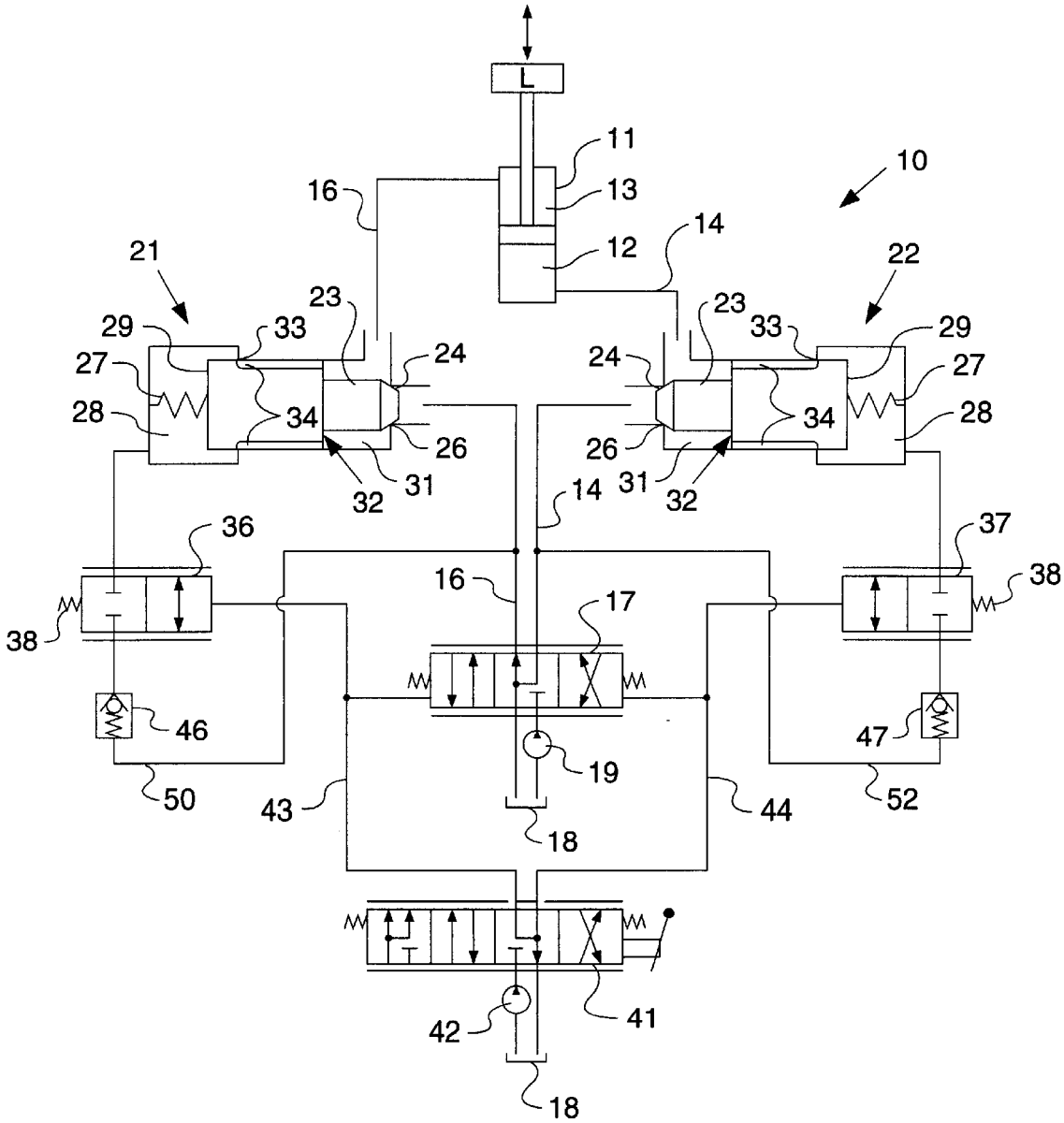
FIG. 2 is a partial diagrammatic and partial schematic representation of another embodiment of the present invention.

Referring to FIG. 2, another embodiment of the subject invention is illustrated. Like elements have like element numbers. Since the embodiment of FIG. 2 is similar to that of FIG. 1, only the differences between the two embodiments will be described. In FIG. 2, the outlet from the float check valve 46 is connected to the conduit 16 between the poppet valve 21 and the directional control valve 17 by an exhaust conduit 50 and the outlet from the float check valve 47 is connected to the conduit 14 between the poppet valve 22 and the directional control valve 17 by an exhaust conduit 52. Any flow through the respective float check valves 46,47 is passed to the associated conduit 16/14 which is a low pressure conduit in which the fluid therein is being passed across the control valve 17 to the tank 18.

Figure 3:
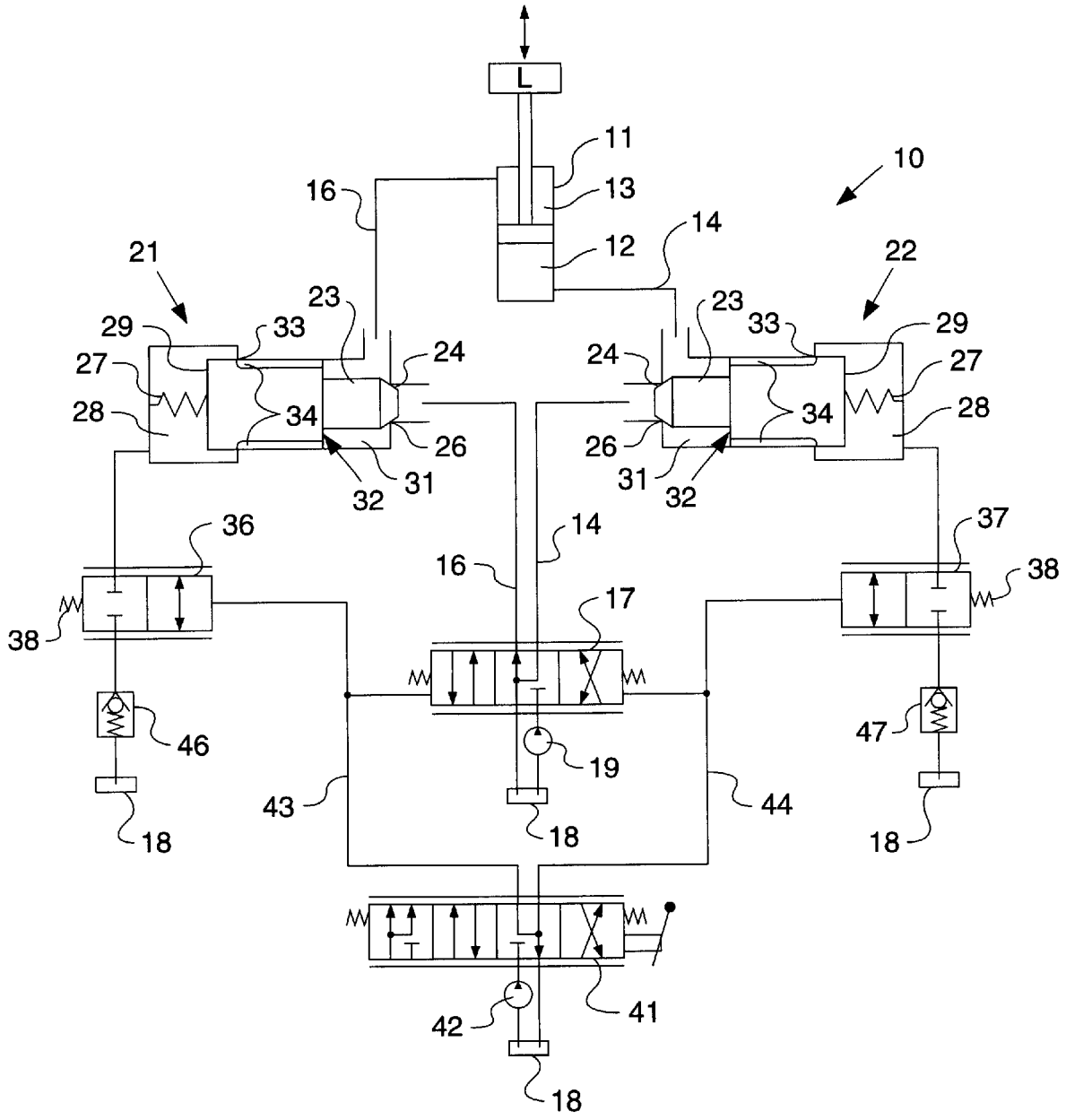
FIG. 3 is a partial diagrammatic and partial schematic representation of another embodiment of the present invention.

Referring to FIG. 3, a third embodiment is illustrated. Like elements have like element numbers. Since the embodiment of FIG. 3 is likewise similar to that of FIG. 1, only the differences between the two embodiments will be described. The only difference set forth in FIG. 3 is that the tank 18 is a pressurized tank. That is, a positive pressure of a desired level is maintained within the tank at all times. This is normally provided by placing a pressure relief valve in the tank to control the pressure level.

INDUSTRIAL APPLICABILITY

In the operation of the embodiment of FIG. 1, a float condition of the control system 10 is established by moving the pilot control valve 41 to its extreme rightward position to simultaneously move the pilot operated valves 36,37 to their open flow communicating positions. This vents both control chambers 28 of the poppet valves 21,22 to the tank 18 so that the poppets 23 are biased to their closed positions only by the low force springs 27. The directional control valve 17 will remain at its neutral position shown by virtue of the pilot pressure at the opposite ends thereof being equal.

The primary use of the float condition is to permit the implement to follow the contour of the surface without operator intervention. This causes the hydraulic cylinder to extend and retract as the implement travels over bumps and/or depressions. For example, when the implement traverses a bump, the hydraulic cylinder 11 extends resulting in a positive pressure being generated in the retract side 13 and in the reaction chamber 31 of the poppet valve 21 and a negative pressure being generated in the extend side 12 and the reactive chamber 31 of the poppet valve 22. The negative pressure is a result of the extend side needing fluid since the volumetric size of the extend side of the cylinder is increasing. The positive pressure in the reaction chamber 31 of the poppet valve 21 moves the poppet 23 of the poppet valve 21 leftward unseating the conical face 24 from the valve seat 26. The leftward movement of the poppet 23 of the poppet valve 21 forces the fluid from the control chamber 28 of the poppet valve 21 through the open control valve 36 and the float check valve 46 and into the tank 18. Unseating the poppet 23 of the poppet valve 21 permits the pressurized fluid from the retract side 13 to pass through the conduit 16 to the directional control valve 17 and into the tank 18 and the conduit 14 where it acts on the end of the poppet 23 of the poppet valve 22. Simultaneously the negative pressure in the reaction chamber 31 of the poppet valve 22 is being communicated through the variable orifice 33 into the control chamber 28 of the poppet valve 22. The float check valve 47 prevents fluid from the tank 18, which is at a higher pressure level than the negative pressure in the control chamber 28, from passing through the open control valve 37 and into the control chamber 28 of the poppet valve 22. If the higher, atmospheric pressure from the tank 18 were permitted to enter the control chamber 28, the force of the spring in cooperation with the force of the atmospheric pressure would move the poppet valve 22 to a closed position thus blocking flow needed to fill the extend side 12 of the cylinder. Consequently, the fluid being exhausted from the retract side 13 has a sufficient force to unseat the poppet 23 of the poppet valve 22 and flow into the extend side 12.

Similarly, when the implement traverses a depression or is being lowered from a raised position by moving the pilot control valve 41L to its float position, the weight of the implement retracts the hydraulic cylinder 11 causing positive pressure to be generated in the extend side 12 and the reaction chamber 31 of the poppet valve 22 and a negative pressure to be generated in the retract side 13 and the reaction chamber 31 of the poppet valve 21 and across the orifice 33 to the control chamber 28. The float check valve 46 likewise prevents the higher, atmospheric pressurized fluid in the tank 18 from passing through the open valve 36 and into the control chamber 28 of the poppet valve 21. The positive pressure in the reaction chamber 31 of the poppet valve 22 thus unseats the poppet valve 23 of the poppet valve 22 and passes exhaust fluid through the conduit 14, the control valve 17 and into the tank 18 and the conduit 16. The positive pressure fluid in the conduit 16 unseats the poppet 23 of the poppet valve 21 and fills the evacuating retract side 13.

Referring to the operation of the embodiment set forth in FIG. 2, the operation is basically the same as that with respect to FIG. 1. However, in the embodiment of FIG. 2, the fluid passing through the float check valve 46 is returned to the tank 18 through the conduit 50, conduit 16, and the control valve 17. Likewise, fluid passing through the float check valve 47 is returned to the tank 18 through the conduit 52, conduit 14, and the control valve 17. In this arrangement, if flow is being exhausted from the extend side 12 due to bucket or the like, a positive pressure could exist in both of the conduits 14,16, due to resistance to fluid flow in the conduits, as the fluid is being directed through the conduit 14 across the control valve and to the tank 18. At the same time a negative pressure is being generated in the retract side 13 due to the movement of the cylinder. The same negative pressure is also in the reaction chamber 31 and the control chamber 28 of the poppet valve 21. If the positive pressure within the conduits 14,16 were permitted to pass through the conduit 50 and enter the pressure chamber 28 of the poppet valve 21, the poppet 23 would close and not permit any fluid thereacross to fill the retract side 13. The float check valve 46 serves to block any pressurized fluid thereacross from the conduit 16 through the conduit 50. All other aspects of the operation is the same as that of FIG. 1.

Referring to the operation of the embodiment of FIG. 3, the operation is basically the same as that set forth in FIG. 1 except the tank in FIG. 3 is pressurized at all times. In this embodiment, if the cylinder is being retracted, the exhaust fluid is being passed through the conduit 14d, across the poppet valve 22 to the tank 18 and simultaneously to the conduit 16. Since the tank 18 is pressurized, the pressure level of the tank and any pressure due to resistance of flow in the conduits is available to act on the poppet 23 of the poppet valve 21 urging it open. This force would be sufficient to open the poppet 23 thus permitting fluid flow to the retract side 13 of the cylinder 11. However, if the positive pressure within the tank 18 were permitted to enter the pressure chamber 28 of the poppet valve 21, the combined force of the pressurized fluid from the tank 18 and the force from the spring 38 would effectively keep the poppet 23 closed thus prohibiting any flow from reaching the retract side 13 of the cylinder 11. The float check valve 46 serves to block the pressurized fluid from the tank 18.

If the cylinder 11 was moving in the opposite direction, the float check valve 47 functions in the same manner to block the pressurized fluid within the tank 18 from reaching the control chamber 28 of the poppet valve 22.

In view of the above it is readily apparent that the structure of the present invention provides a float function for a hydraulic control system having at least one poppet valve disposed between at least one side of a double acting hydraulic cylinder and the tank to permit the cylinder to freely extend and retract in response to external forces without operator intervention. The float condition is achieved by the use of a float check valves 46/47 disposed between the tank 18 and the control clamber 28 of the poppet valves 21/22. The float check valve prevent higher pressurize fluid in *he tank, as compared to the pressure in the control chambers 28, from being transmitted into the control chamber of the poppet valve where it would hold the poppet in a flow blocking position.

Other aspects, objects and advantages of this invention can be obtained from a study of the drawings, the disclosure and the appended claims.

What is claimed is:

1. A control system for controlling a double acting hydraulic cylinder adapted to be connected to a work implement on a machine, the hydraulic cylinder having a retract side and an extend side, the system comprising:

a tank;

a poppet valve disposed between the tank and the extend side of the cylinder and having a control chamber and an orifice continuously communicating the control chamber with the extend side;

a pilot operated control valve having an operative position to exhaust fluid flow from the control chamber of the poppet valve;

a pilot valve having an operative position for moving the pilot operated control valve to the operative position; and a float check valve disposed downstream of the control chamber of the poppet valve to prevent flow of fluid back to the control chamber of the poppet valve.

2. The control system of claim 1 wherein the fluid being exhausted from the control chamber of the poppet valve is being directed to the tank.

3. The control system of claim 2 including a second poppet valve disposed between the retract side of the cylinder and the tank, a second pilot operated control valve having an operative position to exhaust fluid flow from the control chamber of the second poppet valve, a second pilot valve having an operative position for moving the second pilot operated control valve to the operative position, and a second float check valve disposed downstream of the control chamber of the second poppet valve to prevent flow of fluid back to the control chamber of the second poppet valve.

4. The control system of claim 3 wherein the first and second pilot operated control valves are respectively disposed between the pressure chamber of the first and second poppet valves and the first and second float check valve.

5. The control system of claim 4 wherein the tank is a pressurized tank.

6. The control system of claim 1 wherein the fluid being exhausted from the control chamber of the poppet valve is being exhausted to a location between the poppet valve and the tank.

7. The control system of claim 6 including a second poppet valve having a control chamber and being disposed between the retract side of the cylinder and the tank, a second pilot operated control valve disposed downstream of the control chamber of the second poppet valve and having an operative position to exhaust fluid flow from the control chamber of the second poppet valve to a location between the second poppet valve and the tank, a second pilot valve having an operative position for moving the second pilot operated control valve to the operative position, and a second float check valve disposed downstream of the second pilot operated control valve to prevent flow of fluid back to the control chamber of the second poppet valve.

8. The control system of claim 7 wherein the tank is a pressurized tank.

9. The control system of claim 8 including a directional control valve disposed between the tank and extend and retract sides of the cylinder and the exhaust from the respective control chambers are connected between the respective first and second poppet valves and the tank upstream of the directional control valve.

* * * * *